US005832911A

United States Patent [19]

Mayville et al.

[11] Patent Number: 5,832,911

[45] Date of Patent: Nov. 10, 1998

[54] LESS LETHAL WEAPON ATTACHABLE TO LETHAL WEAPON

[75] Inventors: Wayne R. Mayville, Phoenix; Thomas E. Wergen, Glendale, both of Ariz.

[73] Assignee: Universal Propulsion Company, Inc., Phoenix, Ariz.

[21] Appl. No.: 683,323

[22] Filed: Jul. 18, 1996

[51] Int. Cl.[6] ..... F41B 11/02

[52] U.S. Cl. ..... 124/73; 124/53.5; 124/74

[58] Field of Search ..... 124/45, 53.5, 56, 124/73, 74, 76, 83, 84

[56] References Cited

U.S. PATENT DOCUMENTS

| | | | |
|---|---|---|---|
| 2,312,244 | 2/1943 | Feltman | 124/53.5 X |
| 2,398,813 | 4/1946 | Swisher | 124/53.5 X |
| 2,554,116 | 5/1951 | Monner | 124/76 X |
| 2,573,884 | 11/1951 | Wells | 124/45 |
| 2,965,000 | 12/1960 | Skinner | 124/73 X |
| 4,143,636 | 3/1979 | Liepins et al. | 124/76 X |
| 4,191,158 | 3/1980 | Curran | 124/76 |
| 4,531,503 | 7/1985 | Shepherd | 124/76 |

FOREIGN PATENT DOCUMENTS

| | | | |
|---|---|---|---|
| 1166326 | 10/1969 | United Kingdom | 124/53.5 |

*Primary Examiner*—John A. Ricci
*Attorney, Agent, or Firm*—Pennie & Edmonds LLP

[57] ABSTRACT

A weapon comprising a combination lethal weapon and less lethal gas-powered weapon mounted below the lethal weapon. The less lethal weapon which fires projectiles is independently operable when dismounted and includes a bolt, gas supply and magazine features.

7 Claims, 7 Drawing Sheets

LESS LETHAL WEAPON ATTACHABLE TO LETHAL WEAPON

BACKGROUND OF THE INVENTION

Numerous attachments to rifles have been proposed including grenade and non-lethal launchers attachable to the rifle muzzle (U.S. Pat. Nos. 4,154,012 and 4,270,293) or the underside of the weapon (U.S. Pat. No. 3,442,173). Less than lethal liquid filled balls have also been proposed to be propelled from a barrel extension (U.S. Pat. No. 3,791,303).

Non lethal projectile units including a projectile and propelling charge have been described (U.S. Pat. No. 3,733,727). Paint ball guns with bulk loaders are known (U.S. Pat. No. 5,282,454).

Under barrel rifle mounts have been proposed for grenades and flare launching (U.S. Pat. No. 5,198,600). Air powered paint ball pistols using liquid $CO_2$ have also been described (U.S. Pat. No. 5,462,042) and gas powered pistols have included flow valves and bolt actuators (U.S. Pat. No. 5,280,778).

SUMMARY OF THE INVENTION

Broadly, the present invention is a less lethal projectile launching weapon for discharging projectiles, pellets or other antipersonnel objects used in combination with a lethal weapon or independently. The less lethal mechanism can be attached to a lethal firearm or used as a separate stand-alone weapon.

The weapon includes a novel gas pressure providing system, a novel magazine loading system including a turnable barrel and an improved bolt arrangement. Further, a novel projectile is utilized by the weapon.

DESCRIPTION OF THE PREFERRED EMBODIMENT

With respect to FIGS. 1–4, dual weapon unit 5 includes lethal weapon 6 and less lethal weapon 7 mounted below weapon 6. Weapon 6 includes a barrel, a trigger, a magazine and all necessary components to be a stand-alone weapon.

Figure 1:
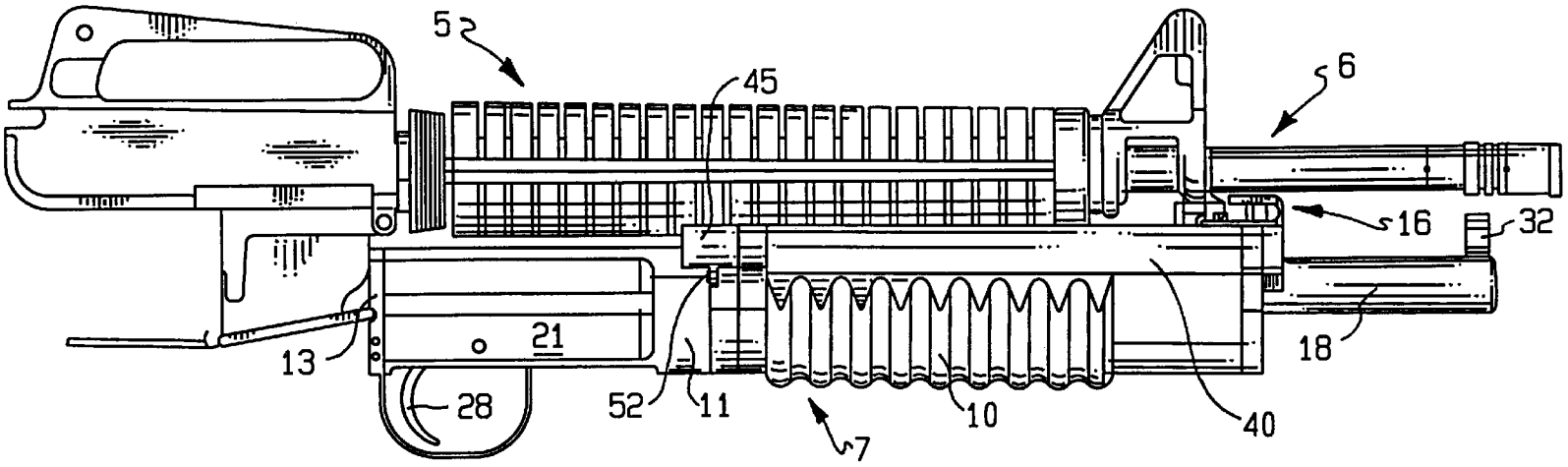
FIG. 1 is a side elevational view of a lethal firearm with an attached less lethal weapon of the present invention.
Figure 1A:
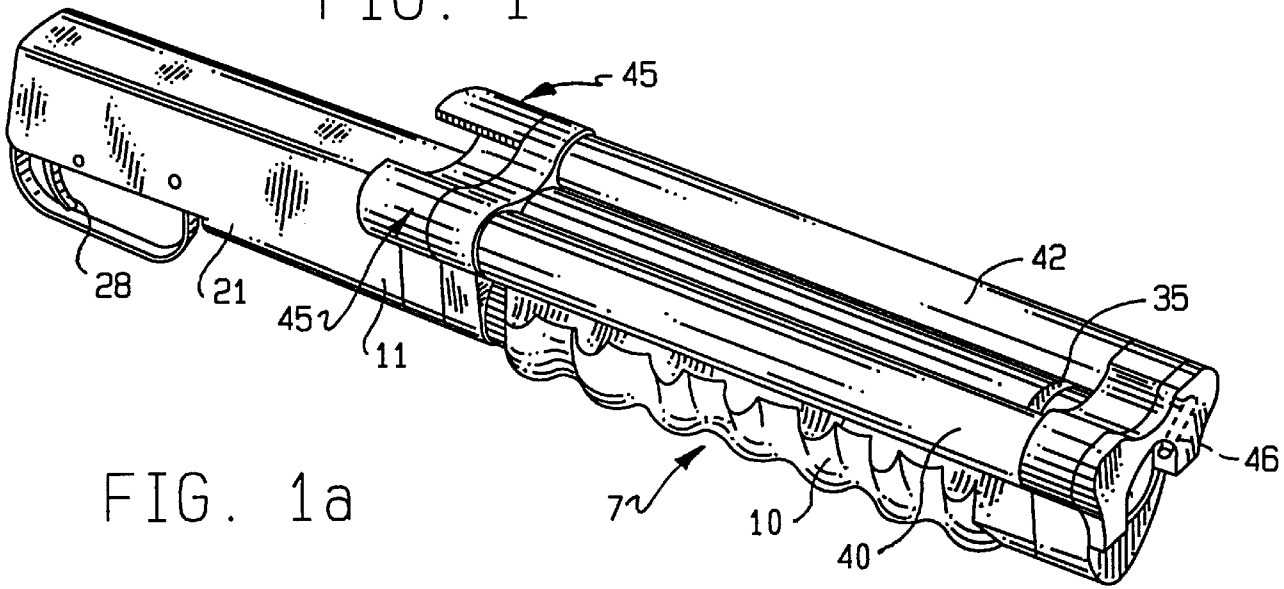
FIG. 1*a* is a perspective view of the less lethal weapon detached from the lethal weapon with the barrel removed.
Figure 2:
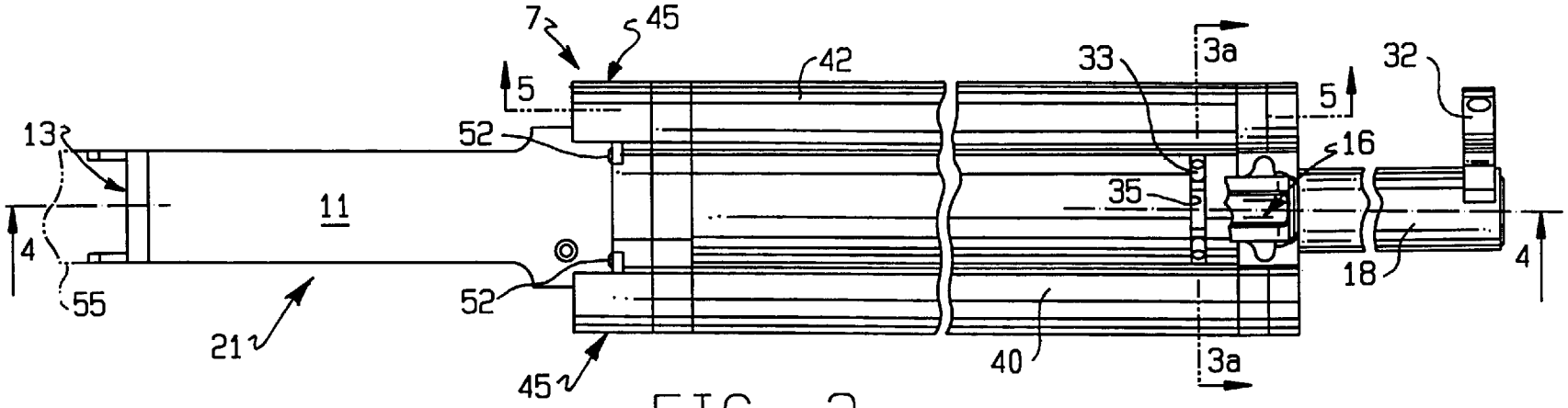
FIG. 2 is a plan view of the less lethal mechanism showing the barrel turning mechanism.
Figure 4:
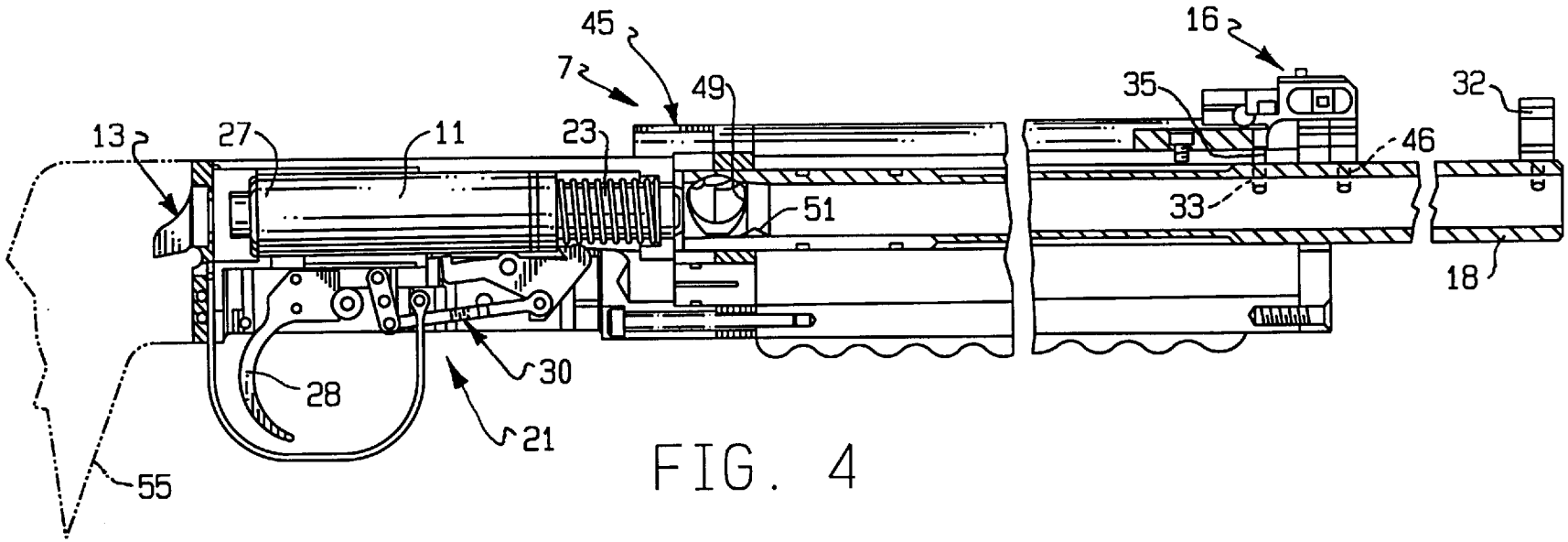
FIG. 4 is a longitudinal sectional view along line 4—4 of FIG. 2.
Figure 3A:
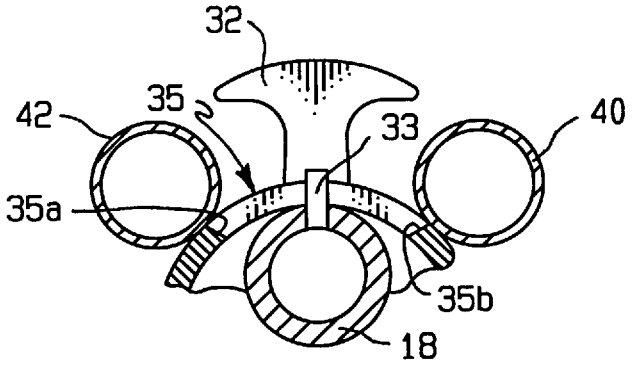
FIG. 3*a* is a sectional view taken along line 3a—3a of FIG. 2.
Figure 3B:
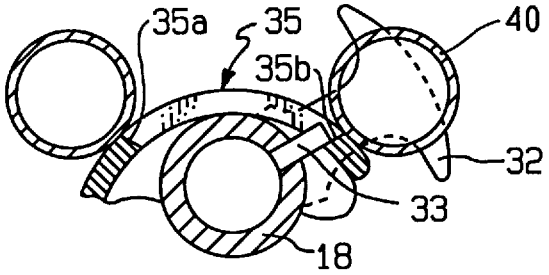
FIGS. 3*b* and 3*c* are similar to FIG. 3*a* showing the barrel turned left and right.
Figure 3C:
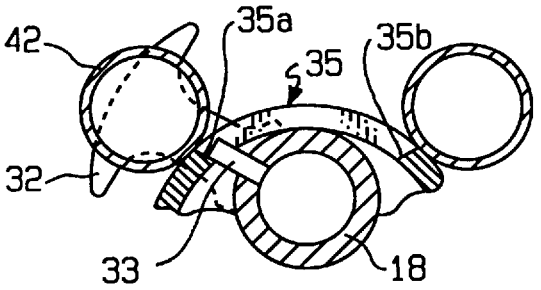

Projectile launching weapon mechanism 7 includes frame 11, mount brackets 13 and 16 for mounting mechanism 7 on lethal weapon 6, barrel 18, receiver 21 (including bolt 23), gas valve section 27, trigger 28 and trigger mechanism 30 (FIG. 4). With particular reference to FIGS. 2, 3*a*–3*c* and 4, barrel 18 has a forward handle 32 for turning barrel 18 from a first position in which barrel 18 is supplied by magazine 40 (FIG. 3*b*) to a second position in which barrel 18 is supplied by magazine 42 (FIG. 3*c*). Barrel 18 carries a projecting pin 33 which rides in arcuate frame groove 35. Groove 35 has stop ends 35*a*, 35*b*. Barrel 18 is turned until pin 33 either engages stop 35*b* in FIG. 3*b* or stop 35*a*. Less lethal weapon 7 further includes two projectile magazines 40, 42 and grip 10 (FIG. 1*a*).

Figure 5:
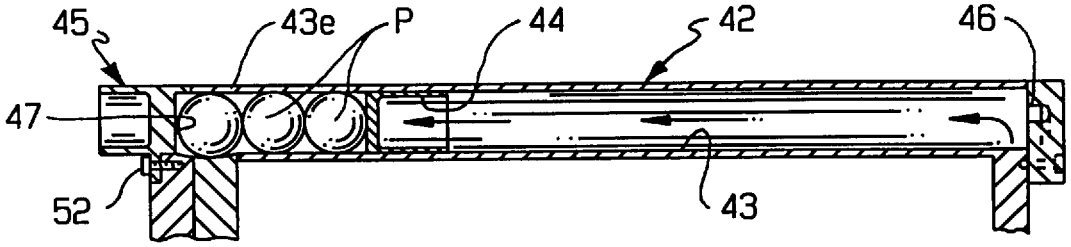
FIG. 5 is a sectional view along line 5—5 of FIG. 2.
Figure 7A:
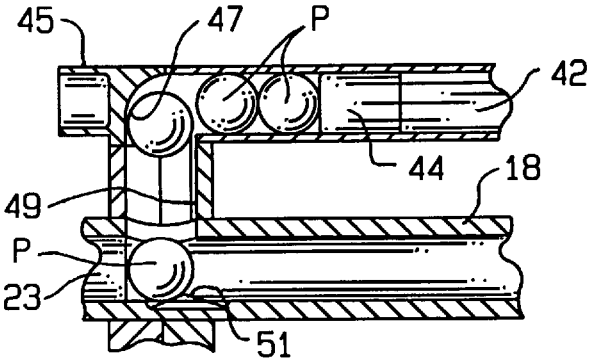
FIG. 7*a* is a partial side elevational view of a projectile exiting a magazine into the barrel.
Figure 7B:
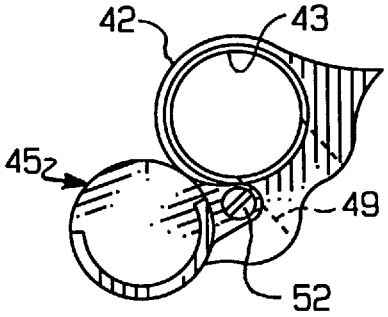
FIG. 7*b* is an end view of the magazine with the loading door open.

Turning to FIGS. 5, 7 and 7*a*, magazine 42 includes projectile storage tube 43 and plastic slidable piston 44 to urge the projectiles (P) toward magazine loading door 45 and adjacent loading chute 49. When the weapon is fired, a portion of the gases propelling projectile (P) are diverted out a hole in barrel 18 (not shown) which is aligned with passage 46 leading to magazine tube 43. Gases do not flow until projectile (P) passes the hole in the barrel in its travel out the end of barrel 18. Gas pressure in tube 43 urges piston 44 toward the tube end 43*e* which is comprised of a cam surface 47 on the interior of loading door 45. When projectile (P) is urged against cam surface 47 the projectile is caused to turn at right angles into projectile loading chute 49 (see FIG. 7*a*) and then into barrel 18 where the projectile rests against spring 51. Spring 51 prevents projectile (P) from exiting barrel 18 prior to firing. Magazine 40 is similarly constructed and is served by barrel gases through a passage similar to passage 46 (not shown) when barrel 18 is turned aligning barrel hole with such similar passage. FIG. 7*b* shows loading door 45 swung open about hinge 52 for loading.

Projectile launching weapon 7 is a complete weapon in that it can be fired attached to weapon 6 or can be detached and used independent of weapon 6. When detached, weapon 6 is readily provided with grip 55 after removal of receiver mount bracket 13 (FIGS. 2 and 4).

Figure 6:
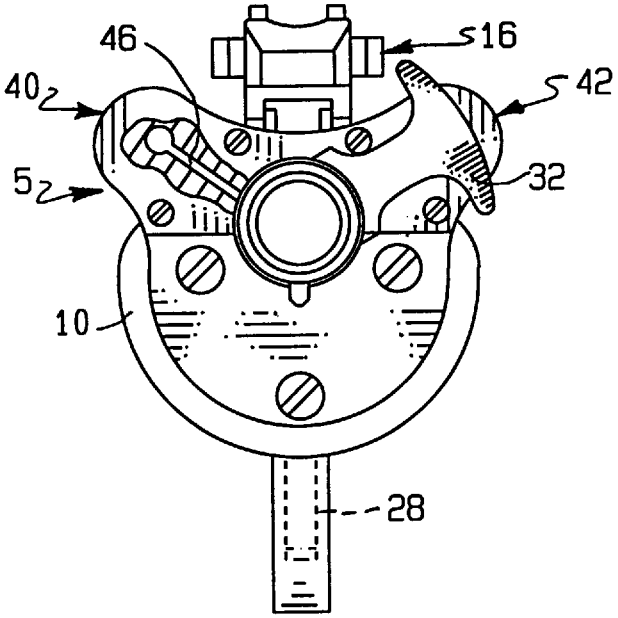
FIG. 6 is a front elevational view of the weapon.
Figure 8:
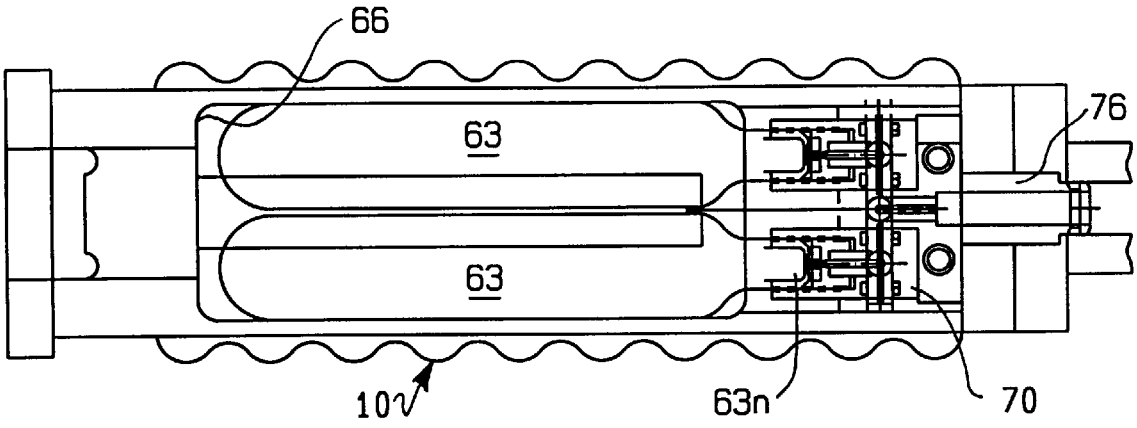
FIG. 8 is a bottom view of the weapon showing the gas bottle storage with the door removed.
Figure 9:
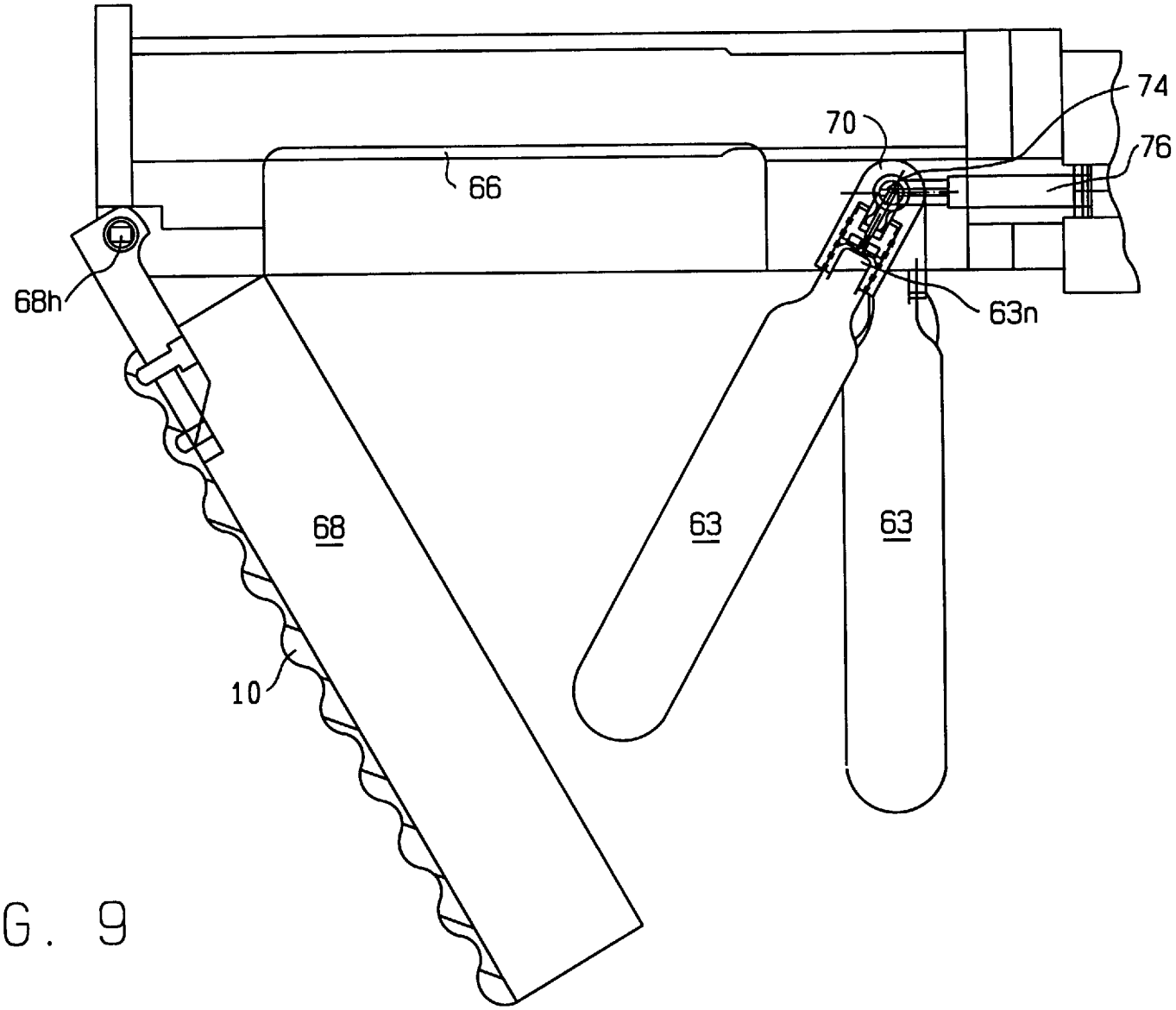
FIG. 9 is a side elevational view of a gas storage door open and a bottle attached and ready to be stowed.

Turning to FIGS. 6, 8 and 9, gas supply units 60, 62 each include one bottle 63 housed in a compartment 66 having a door 68. To install bottles 63 in compartment 66, bottle 63 with its threaded neck 63*n* is screwed into swingable bottle support 70. Support 70 includes a bottle piercer 71 and a curved neck end 73 which end 73 is in gas-sealed contact with the arcuate surface of conduit 74. When bottle 63 is screwed on to threaded support 70 the bottle seal is pierced but gas does not flow into conduit 74 until bottle 63 is swung to a horizontal position which positioning allows bottle gas to communicate with an opening in conduit 74. Conduit 74 in turn communicates with gas pipe 76. Compartment door 68 includes hinge 68*h*.

Figure 10:
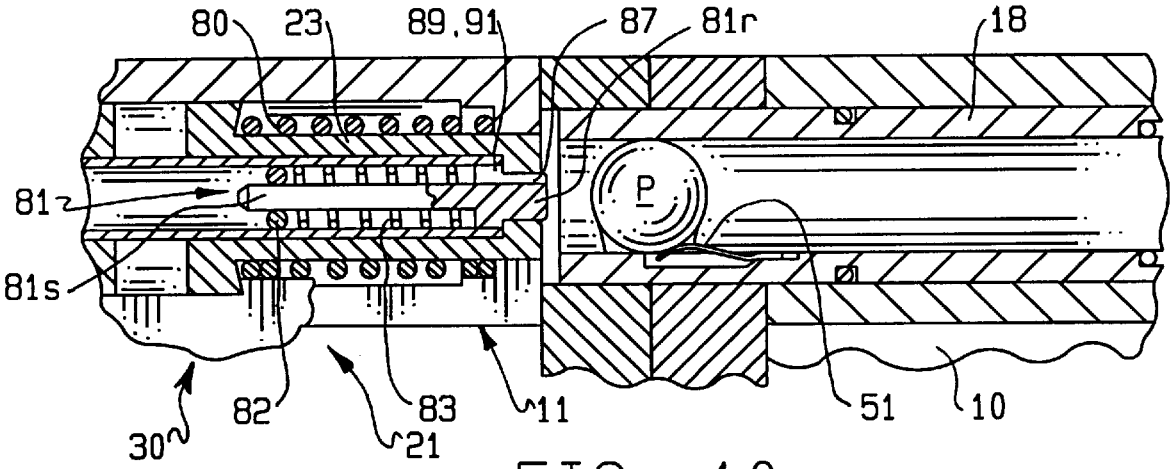
FIG. 10 is a side elevational view of the bolt in ready-to-fire position.
Figure 11:
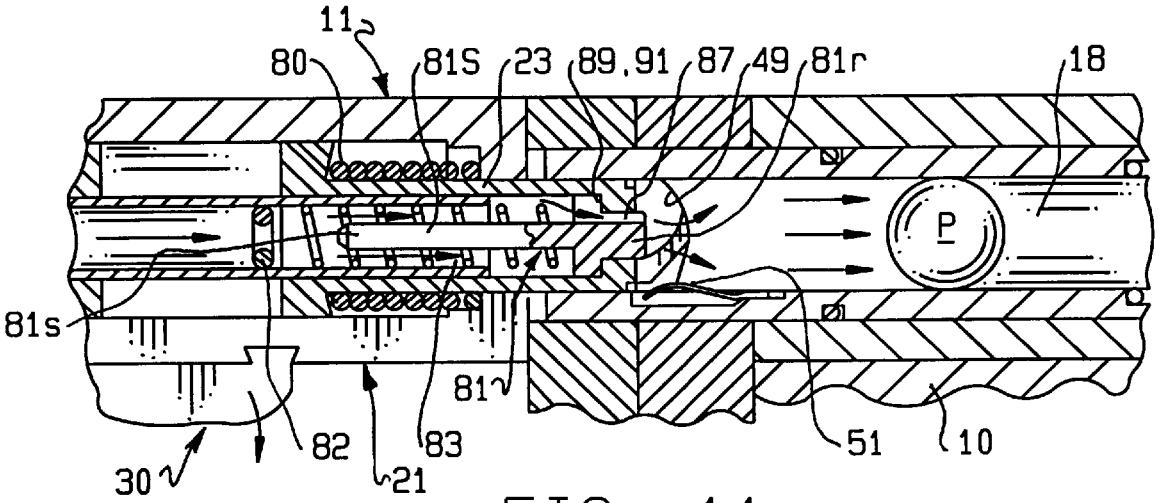
FIG. 11 is a side elevational view of the bolt on its full forward position after firing.
Figure 12:
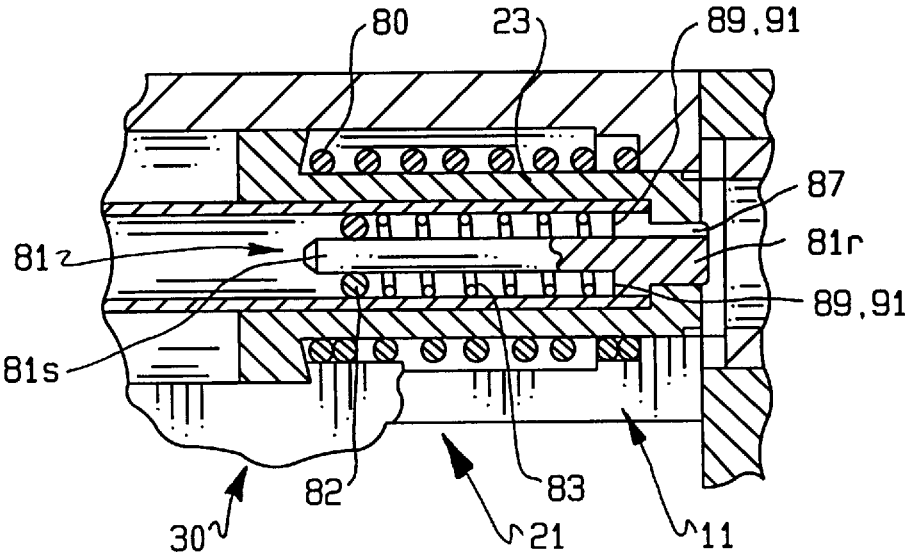
FIG. 12 is an enlarged portion of FIG. 10 showing the piston in the bolt.

Finally turning to FIGS. 10–12, reciprocal bolt 23 is housed in receiver 21 and guided by interior tube 79. Bolt return coil spring 80 urges bolt 23 to the left. Connected to bolt is piston 81 which is sealed by o-ring 82 which o-ring 82 is held in place by o-ring spring 83. When gas valve 27 is activated, gas pressure acting on piston 81 causes piston 81 (and connected bolt 23 which is connected by welding, brazing or otherwise) to move to the right. After limited movement of bolt/piston to the right, piston 81 exits o-ring 82 allowing gases to flow around piston 81 through piston channel 87*s* (FIG. 11). Bolt 23 and its piston 81 strike projectile (P) and simultaneously gases flow through channels 87. The bolt/piston and gases together propel projectile (P) down and out barrel 18.

Piston 81 included stem 81*s* and enlarged restraint section 81*r* which includes restraint shoulder area 89. Shoulder area 89 abuts in surface-to-surface engagement bolt tip area 91 to prevent piston 81 from separating from bolt 23 and exiting down barrel 18.

Projectiles may be hard or soft rubber, liquid or gel-filled "capsules". Dye filled tear gas, pepper or other incapacitating agents may be used. Projectiles (P) may have dimples in their surfaces to improve their aerodynamic characteristics. Projectiles made of Norsorex® brand polynorbornene or similar type materials are preferred. Polynorbornene material is not resilient and therefore causes the body of the person being struck by the projectile to absorb the energy of the moving projectile. Such materials also have good thermal qualities in that they operate well in cold weather. The projectile may have a dimpled surface to improve its flight characteristics.

In the operation of the less-than-lethal weapon 7, loaded gas bottles 63 are installed by engaging neck end 73 with swingable bottle supports 70 (FIG. 9). Bottles 63 together with supports 70 are swung into compartment 66 and door 68 is closed. The swinging of bottles 63 causes gases to enter gas pipe 76 which communicated with gas valve 27 (FIG. 4).

Next, projectiles (P) are loaded in magazines 40,42 through magazine doors 45. Projectiles of one type may be loaded in one magazine and projectiles of another type may be loaded in the other magazine.

Prior to firing, barrel 18 is turned to right or left depending on which magazine the operator desires supply barrel 18. Once the barrel 18 is in the selected position, the barrel loading port 45 for the magazine in service is opened at which time barrel 18 will accept a projectile. The projectile so loaded in barrel 18 is held from rolling out barrel 18 by retainer spring 51 (see FIG. 10).

The firing and reloading sequence is as follows: (1) trigger 28 is pulled causing gases to be introduced against piston 81; (2) piston 81 is moved forward by the gases carrying with it attached bolt 23 causing piston 81 to unseal from o-ring 82 allowing gases into barrel 18; (3) at the same time piston 81 strikes projectile (P) causing spring 51 to deform and projectile (P) to exit barrel 18; (4) gases are diverted from a portion of the forward barrel opposite the forward end of the magazine then serving the barrel into magazine passage 46; and (5) the gases so bled into the magazine urge magazine piston rearwardly which in turn urges the row of projectiles rearwardly until a projectile (P) is deposited in barrel 18 placing the weapon in its ready-to-fire mode.

We claim:

1. A less lethal weapon including a barrel with a rearward portion and a forward portion for propelling a plurality of projectiles seriatim out the barrel including a receiver comprising a) a frame;

b) means for propelling projectiles out of the barrel including the receiver which means is mounted on the frame;

c) a magazine mounted spaced from and parallel to the barrel in turn comprising i) a magazine tube containing a plurality of projectiles;

ii) an exit port communicating with the tube;

iii) a piston slidable in the magazine tube urging the projectiles toward such exit port; and iv) gas pressure means for translating the piston to cause the projectiles to exit seriatim from the tube, such gas pressure means in communication with the forward portion of the barrel.

2. The weapon of claim 1 in which the gas pressure means is a conduit communicating with the barrel.

3. The weapon of claim 1 in which the projectiles are ejected from the barrel by the force of compressed gas.

4. The weapon of claim 1 having two magazines and in which the barrel is turnable to a first position for feeding from the first magazine and turnable to a second position for feeding from the second magazine.

5. The weapon of claim 4 in which each magazine carries a different type of projectile.

6. A less lethal weapon including a barrel for propelling a plurality of projectiles seriatim out the barrel including a receiver comprising a) a frame;

b) means for propelling projectiles out of the barrel including the receiver which means is mounted on the frame;

c) first and second magazines mounted adjacent the barrel, each magazine in turn comprising i) a magazine tube containing a plurality of projectiles;

ii) an exit port communicating with the tube;

iii) a piston slidable in the magazine tube urging the projectiles toward such exit port;

iv) gas pressure means for translating the piston to cause the projectiles to exit seriatim from the tube; and d) the barrel being turnable to a first position for feeding from the first magazine and turnable to a second position for feeding from the second magazine.

7. The weapon of claim 6 in which the first magazine carries a projectile of a first construction and the second magazine carries a projectile of a second construction.

* * * * *